US005399072A

United States Patent [19]

Westphal

[11] Patent Number: 5,399,072

[45] Date of Patent: Mar. 21, 1995

[54] ELECTRICAL PORTABLE AIR COMPRESSOR

[76] Inventor: Timothy D. Westphal, Rte. 2 Box 52, Goliad, Tex. 77963

[21] Appl. No.: 315,219

[22] Filed: Sep. 29, 1994

[51] Int. Cl.[6] ..... F04B 41/02

[52] U.S. Cl. ..... 417/234; 137/565

[58] Field of Search ..... 417/63, 254; 137/565

[56] References Cited

U.S. PATENT DOCUMENTS

| | | | |
|---|---|---|---|
| D. 301,247 | 5/1989 | Prevosto | D15/9 |
| D. 327,891 | 7/1992 | Morgan | D15/9 |
| 1,694,218 | 12/1928 | Mazard | 137/565 |
| 1,756,806 | 4/1930 | Beach | 417/234 |
| 1,771,889 | 7/1930 | Hobart | 417/234 |
| 2,136,098 | 11/1938 | Browne | 137/565 |
| 2,267,479 | 12/1941 | Sturm et al. | 137/565 |
| 2,804,259 | 8/1957 | Ralston | 417/234 |
| 2,812,895 | 11/1957 | Peeps | 417/234 |
| 2,826,354 | 3/1958 | Field | 417/234 |
| 3,287,883 | 11/1966 | Mott | 137/565 |
| 4,077,747 | 3/1978 | Burenga | 417/234 |
| 4,187,058 | 2/1980 | Fish | 417/234 |
| 4,389,166 | 6/1983 | Harvey et al. | 417/234 |
| 5,030,067 | 7/1991 | Ushiota | 417/234 |
| 5,125,800 | 6/1992 | Wong | 417/26 |
| 5,156,530 | 10/1992 | Rutschle | 417/234 |
| 5,181,833 | 1/1993 | Villa et al. | 417/234 |

FOREIGN PATENT DOCUMENTS

| | | | |
|---|---|---|---|
| 933539 | 9/1955 | Germany | 417/234 |
| 2187258 | 9/1987 | United Kingdom | 417/234 |

*Primary Examiner*—Richard A. Bertsch
*Assistant Examiner*—Peter Korytnyk

[57] ABSTRACT

An electrical portable air compressor with an air storage tank having a relief valve on an end portion therethrough. The relief valve serves to release pressure from the air storage tank. An air pressure gauge is secured to an end portion of the air storage tank. The air pressure gauge has a first outlet, a second outlet and a third outlet. The first outlet serves as means for receiving air from an outside source. The air pressure gauge serves to monitor the amount of air present in and exiting from the air storage tank. A compressor is secured to the end portion of the air storage tank downward of the air pressure gauge. The compressor has an outlet on one side thereof. The outlet has a hose theresecured. The hose is secured to the second outlet of the air pressure gauge. The hose serves to transport generated air from the compressor through the air pressure gauge to the air storage tank. The compressor has a power outlet on a bottom portion thereof. An air hose is adapted for securement with the third outlet of the air pressure gauge. The air hose has a fill nozzle theresecured. The fill nozzle serves to couple with a stem on a tire or the like for filling the tire with air.

4 Claims, 3 Drawing Sheets

FIG 1
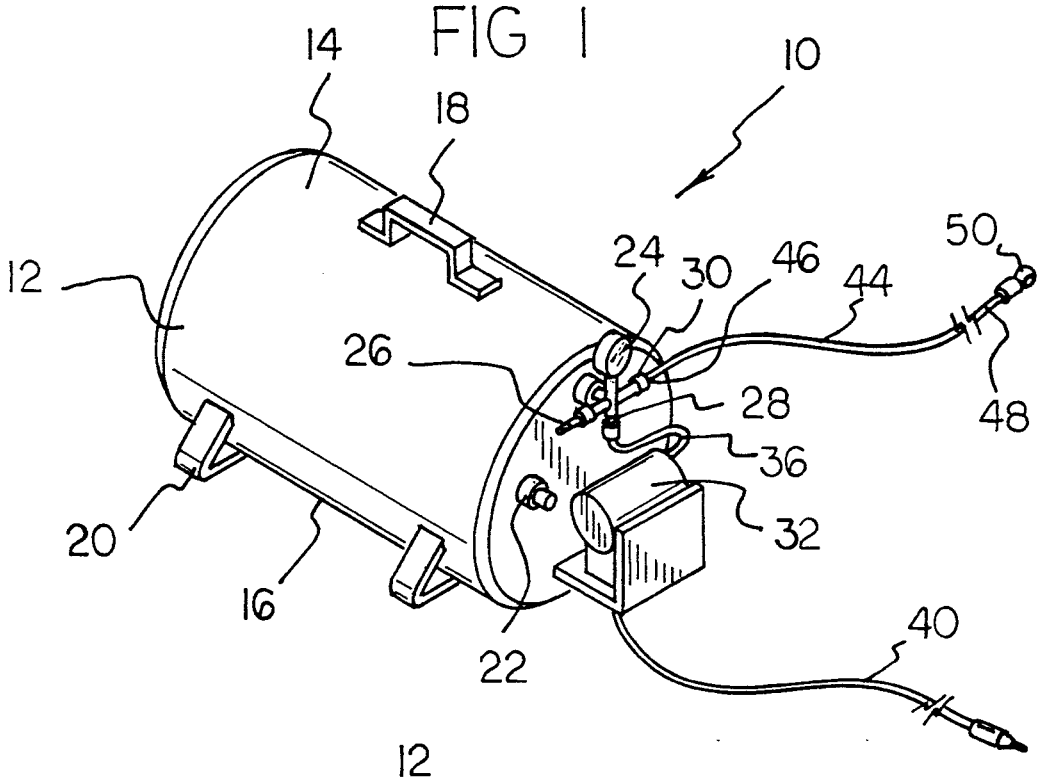
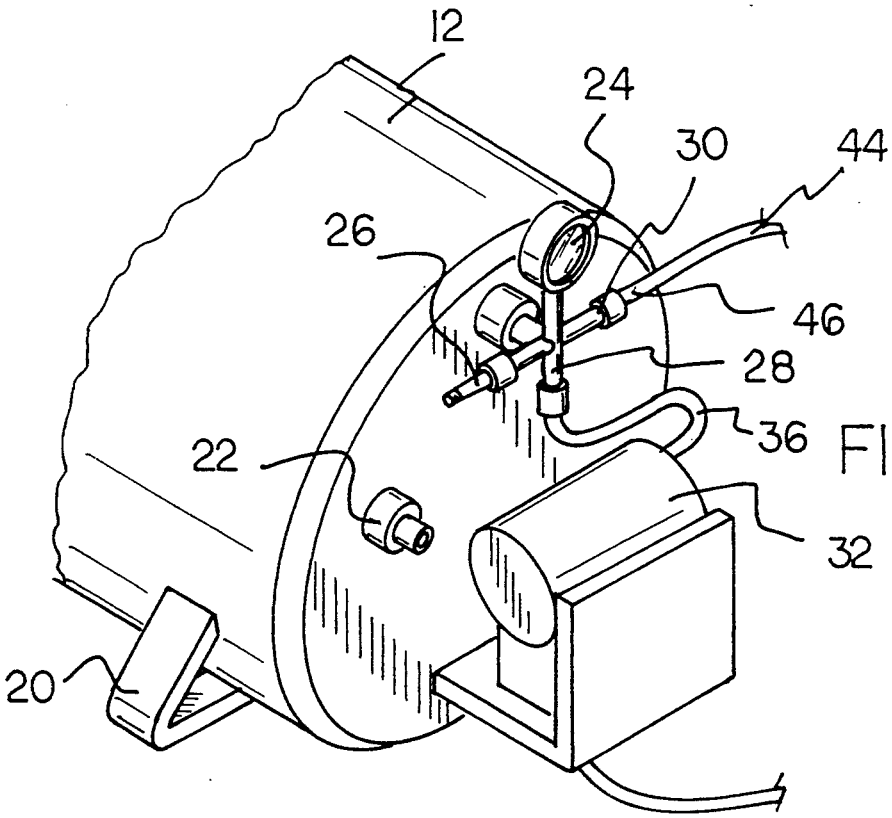
FIG 2

FIG 5
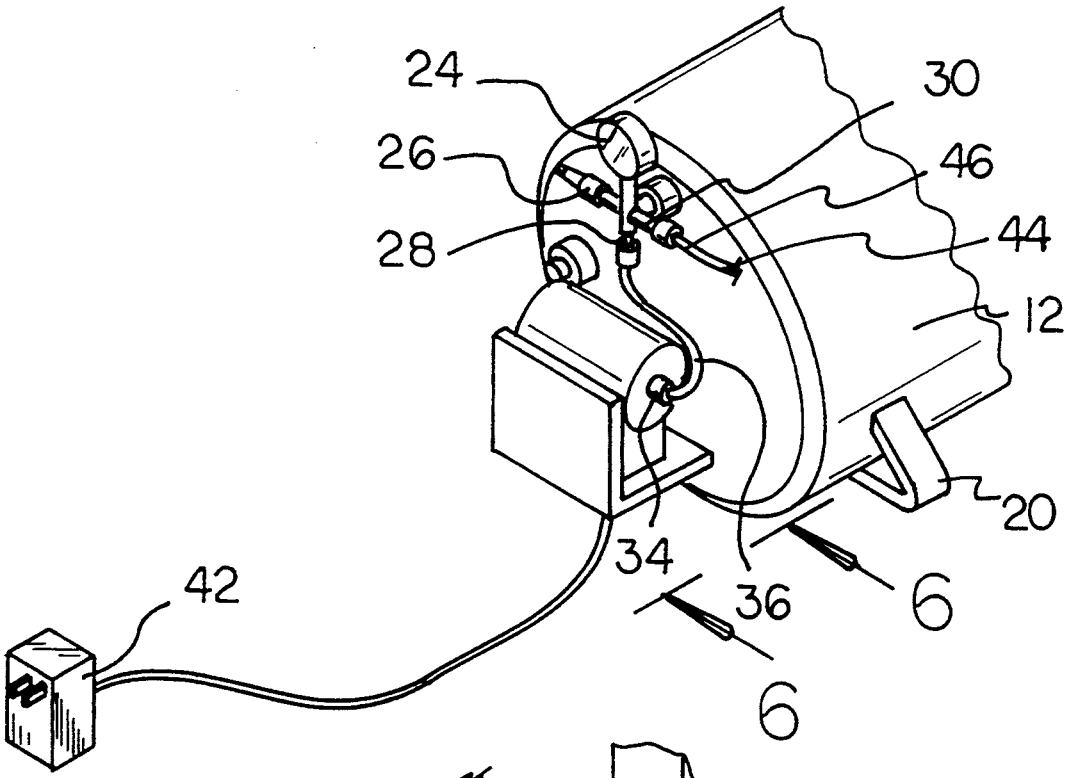
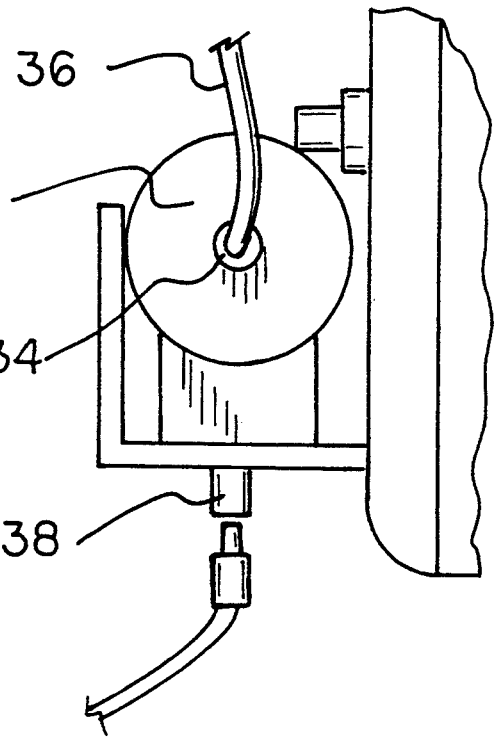
FIG 6

ELECTRICAL PORTABLE AIR COMPRESSOR

BACKGROUND OF THE INVENTION

1. Field of the Invention

The present invention relates to an electrical portable air compressor and more particularly pertains to providing an easy method for filling tires and the like with air with an electrical portable air compressor.

2. Description of the Prior Art

The use of air compressors is known in the prior art. More specifically, air compressors heretofore devised and utilized for the purpose of filling objects with air are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,125,800 to Wong discloses a portable electric air compressor for automobile vehicle.

U.S. Pat. No. Des. 327,891 to Morgan discloses the ornamental design for a portable air compressor.

U.S. Pat. No. Des. 301,247 to Prevosto discloses the ornamental design for a portable air compressor.

U.S. Pat. No. 4,389,166 to Harvey et al. discloses a self-contained portable air compressor.

U.S. Pat. No. 4,187,058 to Fish discloses a portable air compressor.

U.S. Pat. No. 4,077,747 to Burenga discloses a portable air compressor.

While these devices fulfill their respective, particular objective and requirements, the aforementioned patents do not describe an electrical portable air compressor for providing an easy method for filling tires and the like with air.

In this respect, the electrical portable air compressor according to the present invention substantially departs from the conventional concepts and designs of the prior art, and in doing so provides an apparatus primarily developed for the purpose of providing an easy method for filling tires and the like with air.

Therefore, it can be appreciated that there exists a continuing need for new and improved electrical portable air compressor which can be used for providing an easy method for filling tires and the like with air. In this regard, the present invention substantially fulfills this need.

SUMMARY OF THE INVENTION

In the view of the foregoing disadvantages inherent in the known types of air compressors now present in the prior art, the present invention provides an improved electrical portable air compressor. As such, the general purpose of the present invention, which will be described subsequently in greater detail, is to provide a new and improved electrical portable air compressor and method which has all the advantages of the prior art and none of the disadvantages.

To attain this, the present invention essentially comprises an air storage tank having an upper surface and a lower surface. The upper surface has a handle thereattached. The lower surface has two elongated legs theresecured. The air storage tank has a relief valve on an end portion therethrough. The relief valve serves to release pressure from the air storage tank. The device contains an air pressure gauge secured to an end portion of the air storage tank. The air pressure gauge has a first outlet, a second outlet and a third outlet. The first outlet serves as means for receiving air from an outside source. The air pressure gauge serves to monitor the amount of air present in and exiting from the air storage tank. The device contains a compressor secured to the end portion of the air storage tank downward of the air pressure gauge. The compressor has an outlet on one side thereof. The outlet has a hose theresecured. The hose extends upwardly and is secured to the second outlet of the air pressure gauge. The hose serves to transport generated air from the compressor through the air pressure gauge to the air storage tank. The compressor bas a power outlet on a bottom portion thereof. The power outlet serves to electrically couple with a power means for generating the compressor. The device contains an air hose having a first end and a second end. The first end is adapted for securement with the third outlet of the air pressure gauge. The second end has a fill nozzle theresecured. The fill nozzle serves to couple with a stem on a tire or the like for filling the tire with air.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved electrical portable air compressor which has all the advantages of the prior art air compressors and none of the disadvantages.

It is another object of the present invention to provide a new and improved electrical portable air compressor which may be easily and efficiently manufactured and marketed.

It is a further object of the present invention to provide a new and improved electrical portable air compressor which is of durable and reliable construction.

An even further object of the present invention is to provide a new and improved electrical portable air compressor which is susceptible of a low cost of manufacture with regard to both materials and labor, and which accordingly is then susceptible of low prices of sale to the consuming public, thereby making such an electrical portable air compressor economically available to the buying public.

Still yet another object of the present invention is to provide a new and improved electrical portable air compressor which provides in the apparatuses and methods of the prior art some of the advantages thereof, while simultaneously overcoming some of the disadvantages normally associated therewith.

Even still another object of the present invention is to provide a new and improved electrical portable air compressor for providing an easy method for filling tires and the like with air.

Lastly, it is an object of the present invention to provide a new and improved electrical portable air compressor with an air storage tank having a relief valve on an end portion therethrough. The relief valve serves to release pressure from the air storage tank. An air pressure gauge is secured to an end portion of the air storage tank. The air pressure gauge has a first outlet, a second outlet and a third outlet. The first outlet serves as means for receiving air from an outside source. The air pressure gauge serves to monitor the amount of air present in and exiting from the air storage tank. A compressor is secured to the end portion of the air storage tank downward of the air pressure gauge. The compressor has an outlet on one side thereof. The outlet has a hose theresecured. The hose is secured to the second outlet of the air pressure gauge. The hose serves to transport generated air from the compressor through the air pressure gauge to the air storage tank. The compressor has a power outlet on a bottom portion thereof. The power outlet serves to electrically couple with a power means for generating the compressor. An air hose is adapted for securement with the third outlet of the air pressure gauge. The air hose has a fill nozzle theresecured. The fill nozzle serves to couple with a stem on a tire or the like for filling the tire with air.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the electrical portable air compressor constructed in accordance with the principles of the present invention.

FIG. 2 is a partial perspective view of the compressor portion of the present invention.

FIG. 5 is a partial perspective view of the second embodiment of the present invention.

FIG. 6 is a cross-sectional view taken along line 6—6 of FIG. 5.

The same reference numerals refer to the same parts through the various Figures.

DESCRIPTION OF THE PREFERRED EMBODIMENT

Figure 3:
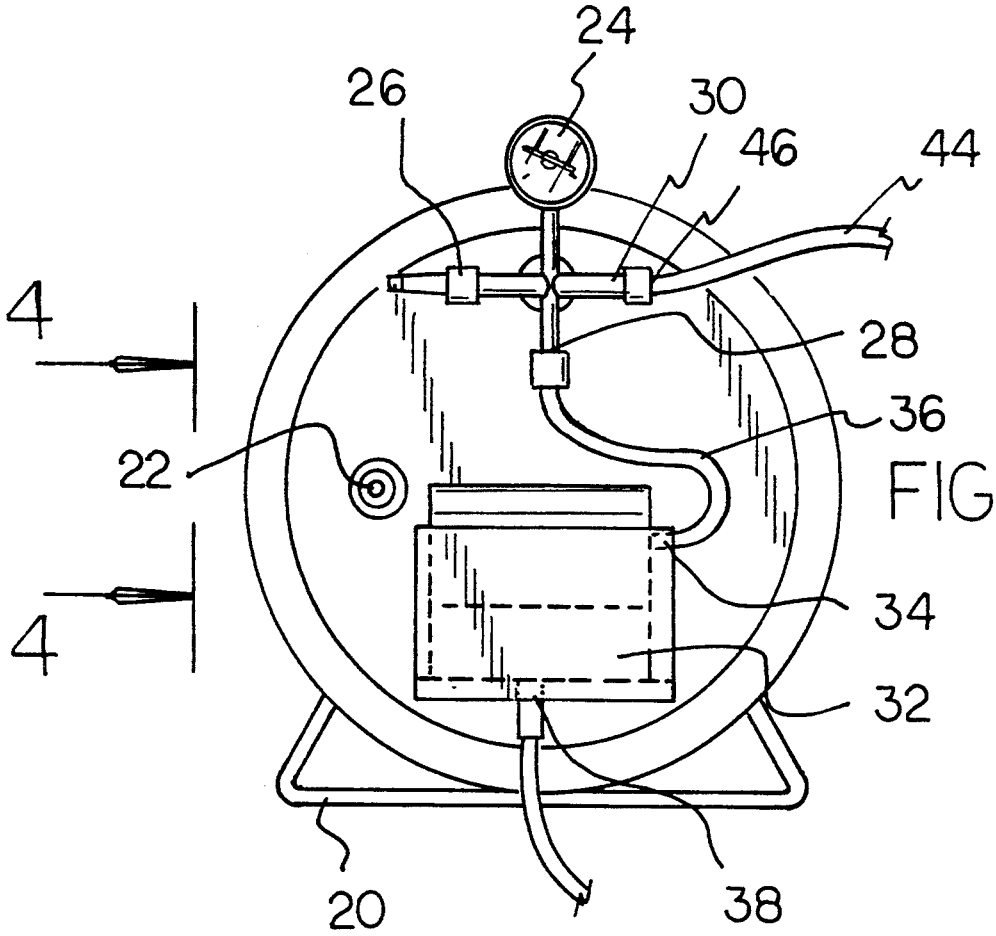
FIG. 3 is an elevated front view of the present invention.
Figure 4:
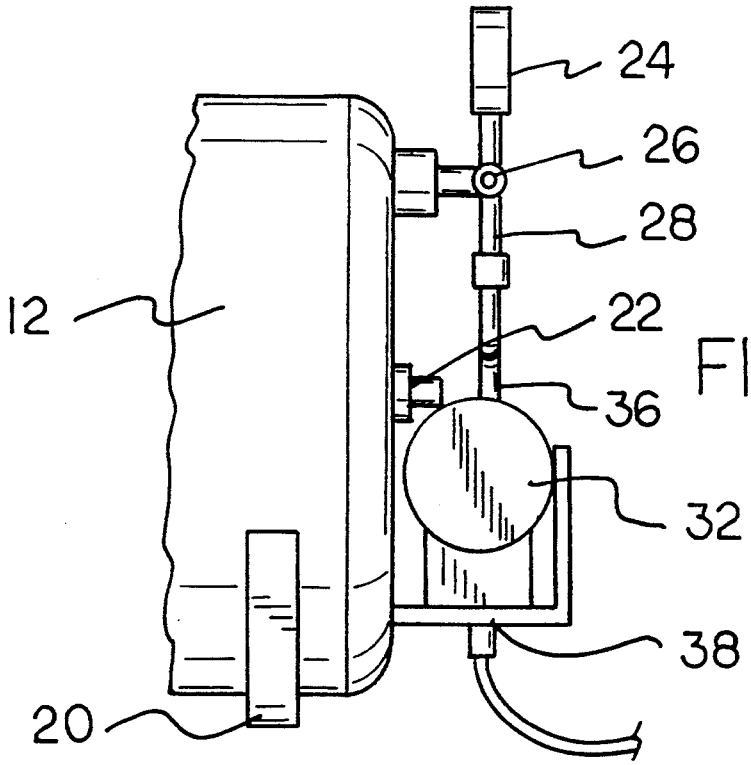
FIG. 4 is an elevated partial side view of the present invention.

With reference now to the drawings, and in particular, to FIG. 1 thereof, the preferred embodiment of the new and improved electrical portable air compressor embodying the principles and concepts of the present invention and generally designated by the reference number 10 will be described.

Specifically, it will be noted in the various Figures that the device relates to a new and improved electrical portable air compressor for providing an easy method for filling tires and the like with air. In its broadest context, the device consists of an air storage tank, an air pressure gauge, a compressor, and an air hose.

The device 10 contains an air storage tank 12 having an upper surface 14 and a lower surface 16. The upper surface 14 has a handle 18 thereattached. The lower surface 16 has two elongated legs 20 theresecured. The air storage tank 12 has a relief valve 22 on an end portion therethrough. The relief valve 22 serves to release pressure from the air storage tank 12. The size of the air storage tank 12 is preferably three or five gallons. The smaller the size of the tank 12, the easier the user will be able to transport the device 10.

The device 10 contains an air pressure gauge 24 secured to an end portion of the air storage tank 12. The air pressure gauge 24 has a first outlet 26, a second outlet 28 and a third outlet 30. The first outlet 26 serves as means for receiving air from an outside source. To save wear and tear on the compressor, the tank 12 can be filled from a larger compressor or from a filling station. The air pressure gauge 24 serves to monitor the amount of air present in and exiting from the air storage tank 12.

The device 10 contains a compressor 32 secured to the end portion of the air storage tank 12 downward of the air pressure gauge 24. The compressor 32 has an outlet 34 on one side thereof. The outlet 34 has a hose 36 theresecured. The hose 36 extends upwardly and is secured to the second outlet 28 of the air pressure gauge 24. The hose 36 serves to transport generated air from the compressor 32 through the air pressure gauge 24 to the air storage tank 12. The compressor 32 is preferably a 12 volt DC compressor with 150 to 200 psi. The compressor 32 has a power outlet 38 on a bottom portion thereof. The power outlet 38 serves to electrically couple with a power means for generating the compressor 32. The power means could be a cigarette connection 40 that couples with a cigarette lighter of an automobile or an electrical plug 42 that could couple with an electrical outlet. The compressor 32 would be able to completely fill the tank 12 in about ten minutes.

The device 10 contains an air hose 44 having a first end 46 and a second end 48. The first end 46 is adapted for securement with the third outlet 30 of the air pressure gauge 24. The second end 48 has a fill nozzle 50 theresecured. The fill nozzle 50 serves to couple with a stem on a tire or the like for filling the tire with air.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. An electrical portable air compressor for filling tires and the like with air comprising, in combination:

an air storage tank having an upper surface, a lower surface, and opposed end portions, the upper surface having a handle thereattached, the lower surface having two elongated legs theresecured, the air storage tank having a relief valve on an end portion therethrough, the relief valve serving to release pressure from the air storage tank;

an air pressure gauge secured to an end portion of the air storage tank, the air pressure gauge having a first outlet, a second outlet and a third outlet, the first outlet serving as means for receiving air from an outside source, the air pressure gauge serving to monitor the amount of air present in and exiting from the air storage tank;

a compressor secured to the end portion of the air storage tank downward of the air pressure gauge, the compressor having an outlet on one side thereof, the outlet having a hose theresecured, the hose extending upwardly and secured to the second outlet of the air pressure gauge, the hose serving to transport generated air from the compressor through the air pressure gauge to the air storage tank, the compressor having a power outlet on a bottom portion thereof, the power outlet serving to electrically couple with a power means for generating the compressor;

an air hose having a first end and a second end, the first end adapted for securement with the third outlet of the air pressure gauge, the second end having a fill nozzle theresecured, the fill nozzle serving to couple with a stem on a tire or the like for filling the tire with air.

2. A new and improved electrical portable air compressor for providing an easy method for filling tires and the like with air comprising, in combination:

an air storage tank having opposed end portions a relief valve on an end portion therethrough, the relief valve serving to release pressure from the air storage tank;

an air pressure gauge secured to an end portion of the air storage tank, the air pressure gauge having a first outlet, a second outlet and a third outlet, the first outlet serving as means for receiving air from an outside source, the air pressure gauge serving to monitor the amount of air present in and exiting from the air storage tank;

a compressor secured to the end portion of the air storage tank downward of the air pressure gauge, the compressor having an outlet on one side thereof, the outlet having a hose theresecured, the hose secured to the second outlet of the air pressure gauge, the hose serving to transport generated air from the compressor through the air pressure gauge to the air storage tank, the compressor having a power outlet on a bottom portion thereof, the power outlet serving to electrically couple with a power means for generating the compressor;

an air hose adapted for securement with the third outlet of the air pressure gauge, the air hose having a fill nozzle theresecured, the fill nozzle serving to couple with a stem on a tire or the like for filling the tire with air.

3. The compressor as described in claim 1 and further including wherein the power means is a cigarette connection that couples with a cigarette lighter of an automobile.

4. The compressor as described in claim 1 and further including a power means consisting of a 120 volt converter that couples with an electrical outlet.

* * * * *